US008033840B2

(12) United States Patent
Wang et al.

(10) Patent No.: US 8,033,840 B2
(45) Date of Patent: Oct. 11, 2011

(54) ELECTRICAL CONNECTOR WITH IMPROVED CONTACTS ARRANGEMENT

(75) Inventors: Chen-Xi Wang, Kunshan (CN); Hong-Qiang Han, Kunshan (CN); Zi-Qiang Zhu, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/980,361

(22) Filed: Dec. 29, 2010

(65) Prior Publication Data

US 2011/0159745 A1 Jun. 30, 2011

(30) Foreign Application Priority Data

Dec. 30, 2009 (CN) ..... 2009 1 0312555

(51) Int. Cl.
*H01R 13/548* (2006.01)
*H01R 4/66* (2006.01)

(52) U.S. Cl. ..... 439/108

(58) Field of Classification Search ..... 439/108, 439/941, 676, 101, 607.07
See application file for complete search history.

(56) References Cited

U.S. PATENT DOCUMENTS

| | | | | |
|---|---|---|---|---|
| 6,935,870 | B2 | 8/2005 | Kato et al. | |
| 7,435,110 | B2 * | 10/2008 | Xiao et al. | 439/107 |
| 7,674,118 | B2 * | 3/2010 | He | 439/108 |
| 7,789,716 | B2 * | 9/2010 | Fedder et al. | 439/751 |
| 7,798,854 | B2 * | 9/2010 | Tanaka | 439/108 |
| 2009/0042450 | A1 * | 2/2009 | Zheng et al. | 439/660 |

* cited by examiner

*Primary Examiner* — Chandrika Prasad

(74) *Attorney, Agent, or Firm* — Wei Te Chung; Andrew C. Cheng; Ming Chieh Chang

(57) ABSTRACT

An electrical connector (100) for being mounted onto a printed circuit board (200) includes an insulative housing (1), a plurality of contacts (2) retained in the insulative housing and a metal shell (3) covering the insulative housing. The insulative housing includes a base (11) and a tongue plate (12) protruding from the base. The contacts have contacting portions (26) retained in the tongue plate and arranged in one row along a transverse direction, and tail portions (28) arranged in two rows along a front-to-back direction for being mounted onto the printed circuit board. The contacts consist of a first type of a plurality of grounding contacts (25) and a second type of a plurality of pairs of differential contacts (21, 22, 23, 24) under condition that each two adjacent pairs of differential contacts have at least one grounding contact located therebetween. At the tail portions, each pair of differential contacts include a first tail portion (281) arranged in one of the two rows and a second tail portion (282) arranged in the other row.

20 Claims, 7 Drawing Sheets

ELECTRICAL CONNECTOR WITH IMPROVED CONTACTS ARRANGEMENT

BACKGROUND OF THE INVENTION

1. Field of the Invention

The present invention relates to electrical connectors, and more particularly to an electrical connector with improved contacts arrangement.

2. Description of Related Art

Type C HDMI (High-Definition Multimedia Interface) connectors present as a medium being widely used in mobiles phones and other electronic devices for electrically connecting the electronic devices with each other to transmit signals. The type C HDMI connector has nineteen contacts arranged in one row and including three pairs of differential contacts (Data+Data−), a pair of clock contacts (Clock+Clock−), five grounding contacts, a CEC signal contact, a SCL signal contact, a SDA signal contact, a reserved signal contact, a +5V power contact, and a hot plug detect contact.

The type C HDMI connector has so many types of the contacts sorted in function that the chipset designed for the type C HDMI connector is complicated. The type C HDMI connector needs many contacts to transmit the so many different types of data, and the manufacturing costs of the type C HDMI connector is increased.

Hence, an improved electrical connector is desired to overcome the above problems.

BRIEF SUMMARY OF THE INVENTION

According to one aspect of the present invention, an electrical connector for being mounted onto a printed circuit board comprises an insulative housing including a base and a tongue plate protruding from the base; a plurality of contacts having contacting portions retained in the tongue plate and arranged in one row along a transverse direction, and tail portions opposite to the contacting portions and arranged in two rows along a front-to-back direction perpendicular to the transverse direction for being mounted onto the printed circuit board, the contacts consisting of a first type of a plurality of grounding contacts and a second type of a plurality of pairs of differential contacts under condition that each two adjacent pairs of differential contacts have at least one grounding contact located therebetween, at the tail portions, each pair of differential contacts comprising a first tail portion arranged in one of the two rows and a second tail portion arranged in the other row; and a metal shell covering the insulative housing.

According to another aspect of the present invention, an electrical connector for being mounted onto a printed circuit board comprises an insulative housing including a base and a tongue plate protruding from the base; a plurality of contacts having contacting portions retained in the tongue plate and arranged in one row along a transverse direction, and tail portions opposite to the contacting portions and arranged in two rows along a front-to-back direction perpendicular to the transverse direction for being mounted onto the printed circuit board, the contacts comprising a pair of first differential contacts for unidirectionally transmitting data, a pair of second differential contacts for bi-directionally transmitting data and a pair of grounding contacts arranged between the pair of first and the pair of second differential contacts at both the contacting portions and the tail portions.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
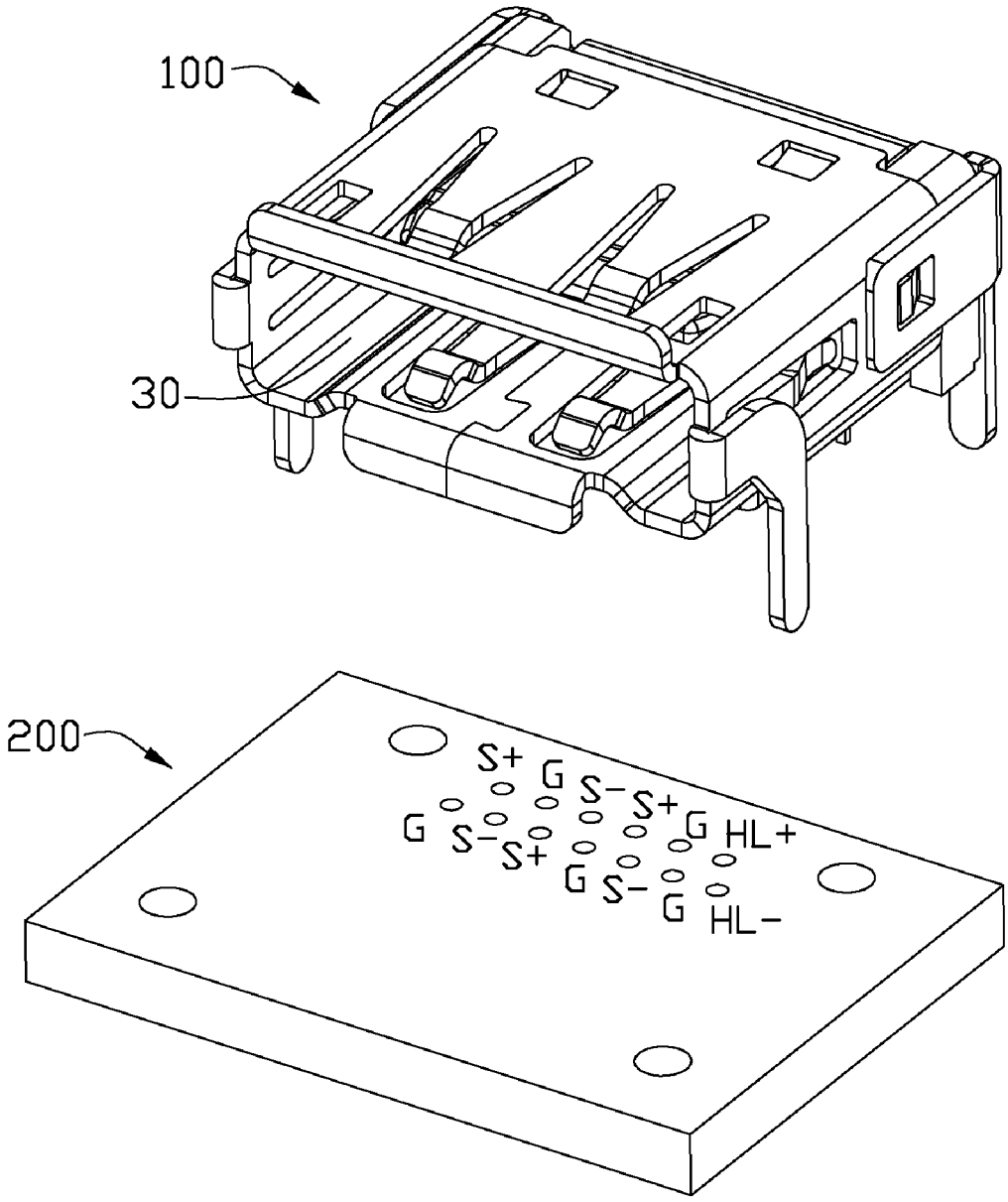
FIG. 1 is a perspective view of an electrical connector and a printed circuit board for the electrical connector mounted thereon according to an embodiment of the present invention.
Figure 2:
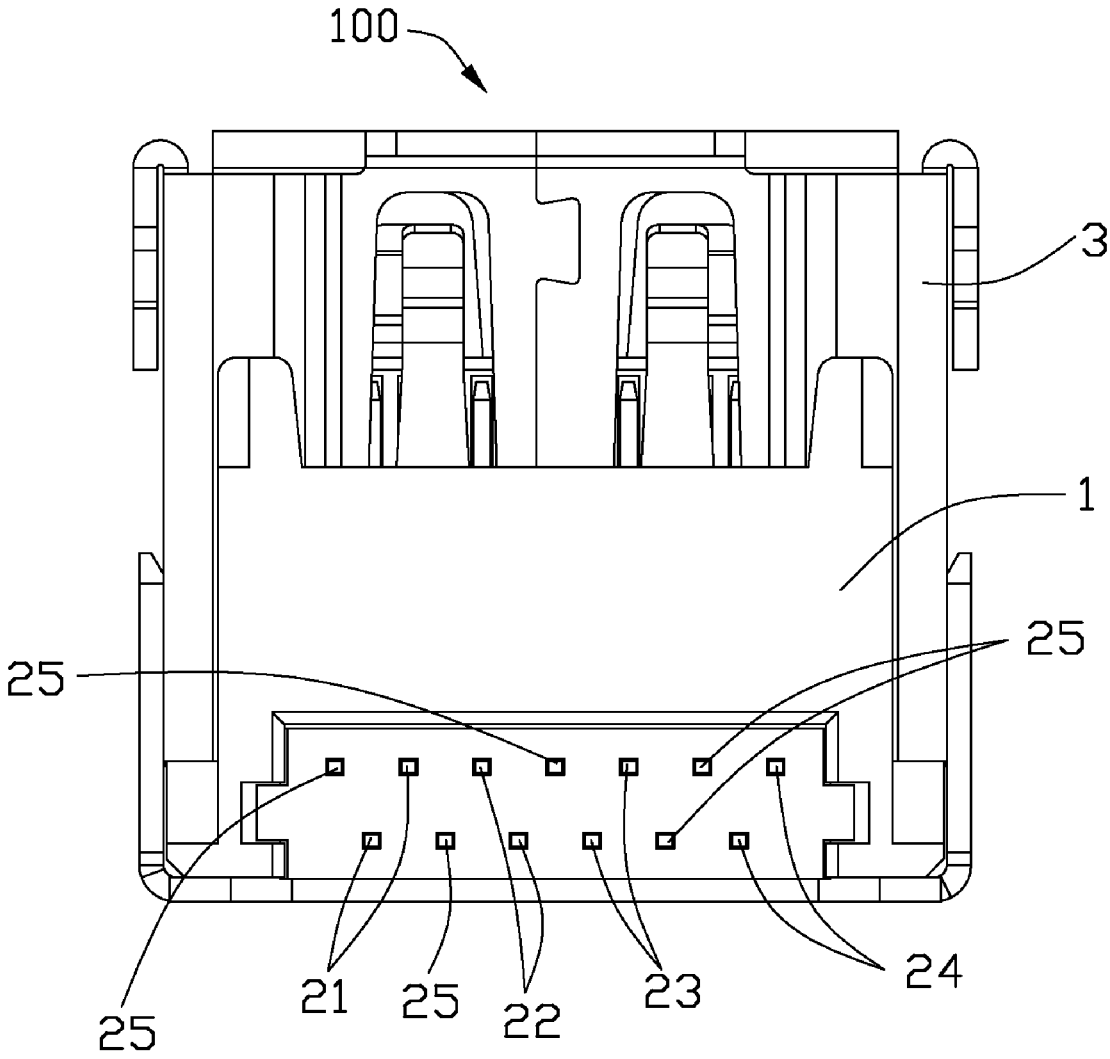
FIG. 2 is a bottom plan view of the electrical connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-4, an electrical connector 100 according to the present invention is a DiiVA (Digital Interactive Interface for Video & Audio) connector for being mounted to a printed circuit board 200 (PCB hereinafter) is disclosed. The electrical connector 100 includes an insulative housing 1, a plurality of contacts 2 retained in the insulative housing 1, a spacer 13 assembled to the insulative housing 1 for retaining contacts 2, and a metal shell 3 covering the insulative housing 1 and defining a receiving space 30 for receiving a matchable plug (not shown) which mates with the electrical connector 100.

Figure 3:
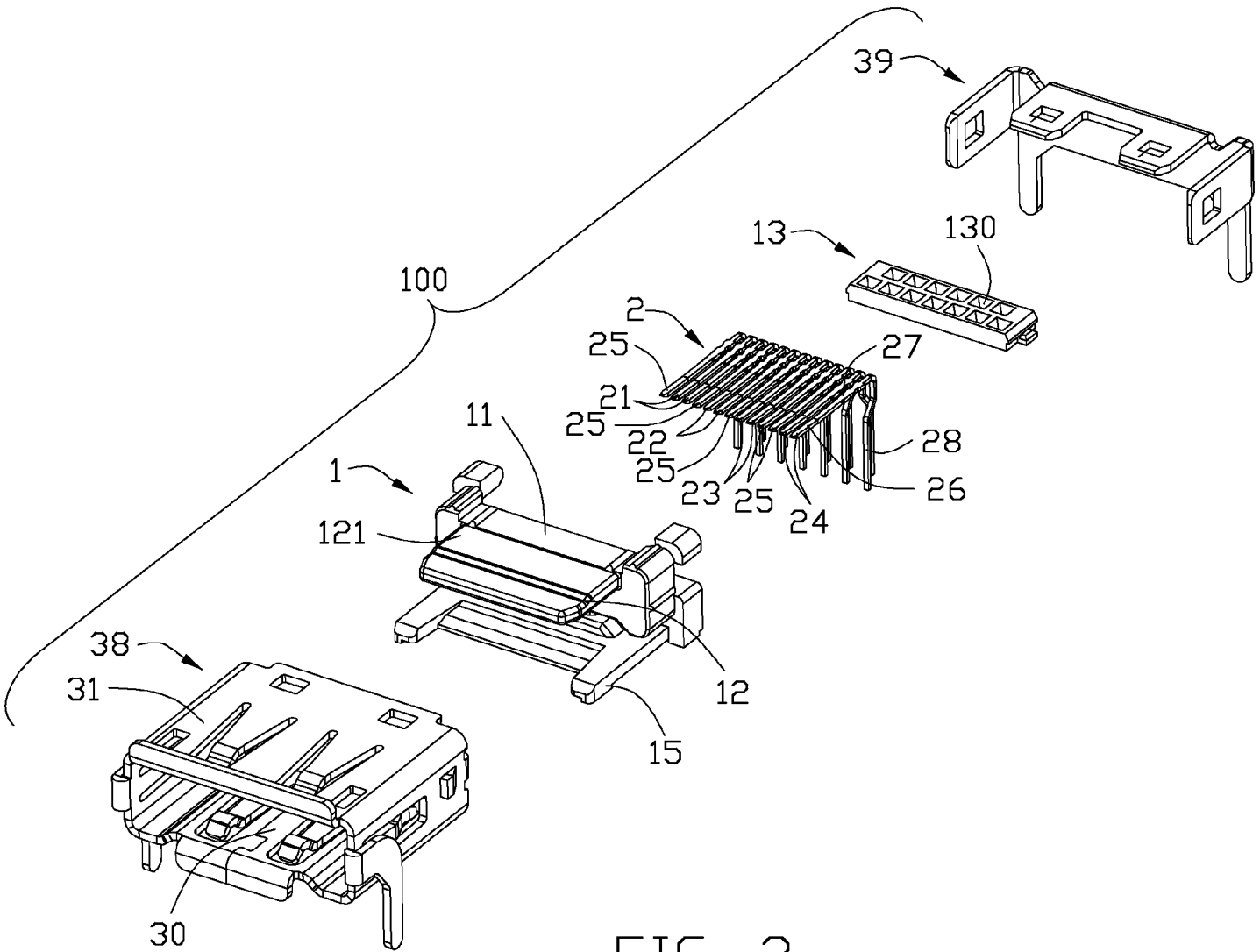
FIG. 3 is an exploded view of the electrical connector shown in FIG. 1.
Figure 4:
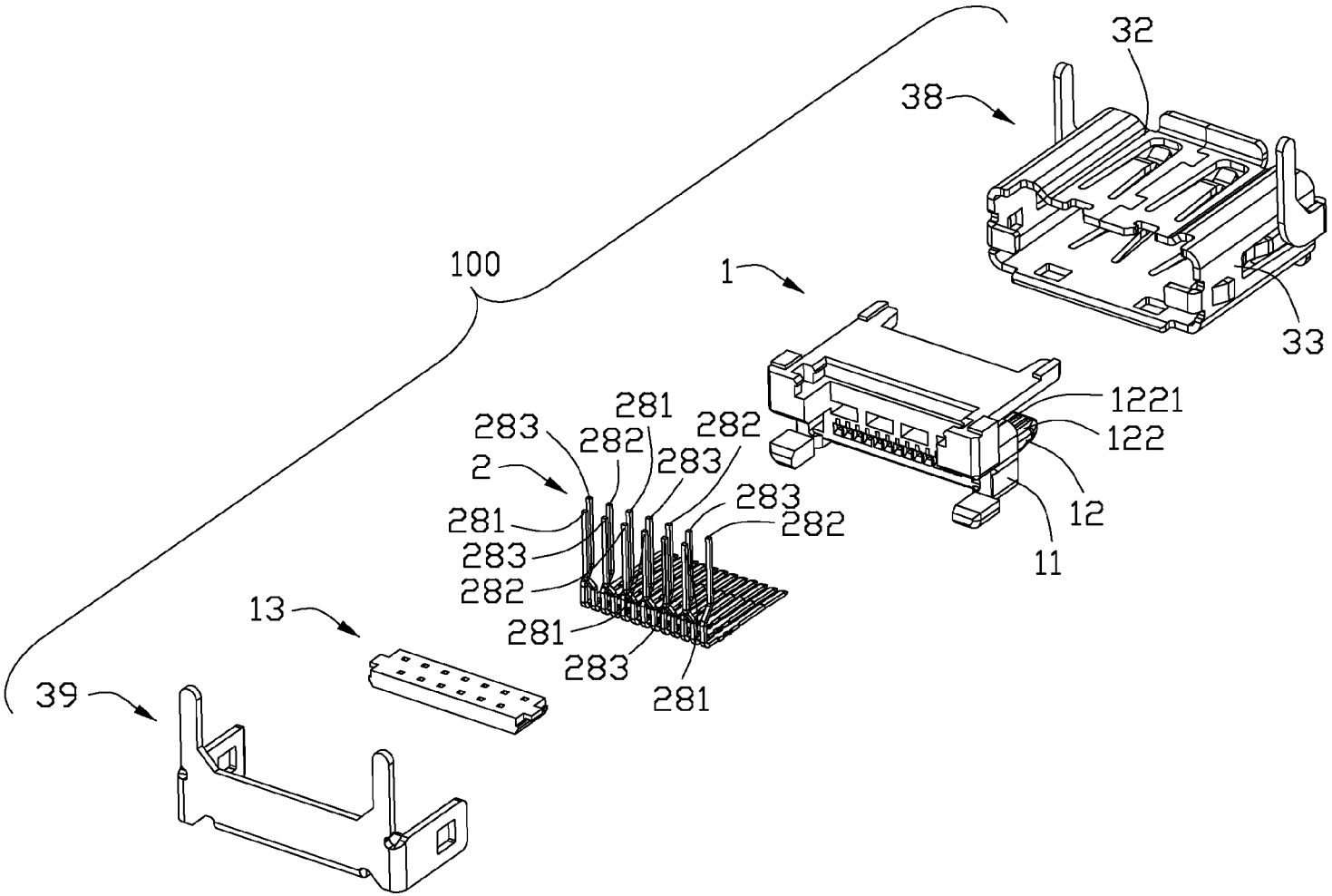
FIG. 4 is a view similar to FIG. 3, while taken from another aspect.

Referring to FIGS. 3 and 4, the insulative housing 1 being molded of dielectric material such as plastic or the like, has a base 11, a tongue plate 12 extending horizontally and forwardly from a front face of the base 11 into the receiving space 30, and a supporting board 15 extending forwardly from the base 11 and being parallel to the tongue plate 12. The tongue plate 12 defines an upper face 121 and a lower face 122 opposite to the upper face 121. A set of passageways 1221 are arranged in the lower face 122 for receiving the contacts 2 respectively. In this embodiment, the tongue plate 12 is integrally formed with the base 11. It is also to be understood that, in other embodiments, the tongue plate 12 and the base 11 can be molded of dielectric material respectively and assembled together to form the insulative housing 1.

Referring to FIGS. 1 to 4, the contacts 2 consist of a first type of five grounding contacts 25 and a second type of a plurality of differential contacts 21, 22, 23, 24. The differential contacts 21, 22, 23, 24 comprise three pairs of first differential contacts 21, 22, 23 for unidirectionally transmitting data and a pair of second differential contacts 24 for bi-directionally transmitting hybrid data. Each pair of differential contacts 21, 22, 23, 24 include a + data contact and a – data contact. Each contact 2 has a retaining portion 27 retained in the base 11, a flat contacting portion 26 extending forwardly from the retaining portion 22 and received in the corresponding passageway 1221, and a tail portion 28 extending downwardly and outwardly beyond the base 11 so as to be soldered into holes of the PCB 200. The spacer 13 has a plurality of perforations 130 passing therethrough for retaining the tail portions 28. The contacting portions 21 are exposed to the receiving space 30 to electrically mate with the matchable plug. All of the contacting portions 21 are arranged in one row along a transverse direction and received in the passageways 1221 on the lower face 122 of the tongue plate 12 so as to decrease a thickness of the tongue plate 12 in a height direction. The three pairs of first differential contacts 21, 22, 23 which unidirectionally transmit data and three grounding contacts 25 are arranged alternatively, a pair of grounding contacts 25 are arranged between one pair of first differential contacts 23 and the pair of second differential contacts 24 which bi-directionally transmit hybrid data, the pair of second differential contacts 24 are located in an outermost side of the contacts 2, therefore, for the contacting portions 26, the contacts 2 are arranged in the following sequence: a grounding contact 25, a pair of first differential contacts 21, a grounding contact 25, a pair of first differential contacts 22, a grounding contact 25, a pair of first differential contacts 23, two grounding contacts 25, and a pair of second differential contacts 24. The space between the pair of first differential contacts 23 and the pair of second differential contacts 24 can be increased, the interference between the pairs of first and second differential contacts 23, 24 can be reduced more effectively. The tail portions 28 are arranged in two rows along a front-to-back direction and in a stagger configuration along the transverse direction. for the tail portions 28, each pair of the differential contacts 21, 22, 23, 24 includes a first tail portion 281 and a second tail portion 282 corresponding to the + data contact and – data contact and arranged in the two rows respectively. The first tail portions 28 of two pairs of first differential contacts 21, 23 and the pair of second differential contacts 24 are arranged in one row of the two rows, and the second tail portions 282 of the two pairs of first differential contacts 21, 23 and the pair of second differential contacts 24 are arranged in the other row. The first tail portion 28 of the remaining pair of first differential contacts 22 is arranged in the row, and the second tail portion 282 of the remaining pair of first differential contacts 22 is arranged in the one row. The grounding contacts 25 include third tail portions 283. The first, second and third tail portions 281, 282, 283 are arranged in the same sequence as the corresponding contacting portions 26 along the transverse direction.

In this embodiment, the contacts 2 are stamped from a contact carrier (not shown) and assembled to the insulative housing 1. In other embodiments, the contact 2 can be integrally molded into the insulative housing 1. Furthermore, the tongue plate 12 can be replaced by a sub printed circuit board, with gold fingers on the sub printed circuit board which replace the contacting portion 26 to electrically mate with the matchable plug.

The metal shell 3 is made of a piece of metallic sheet and includes a front shell 38 and a rear shell 39 coupled to the front shell 38, the front shell 38 has a top wall 31, a bottom wall 32 opposite to the top wall 31 and being supported by the supporting board 15, and a pair of side walls 33 connecting the top and bottom walls 31, 32. The receiving space 30 is surrounded by the top wall 31, the bottom wall 32, and the side walls 33.

Figure 5:
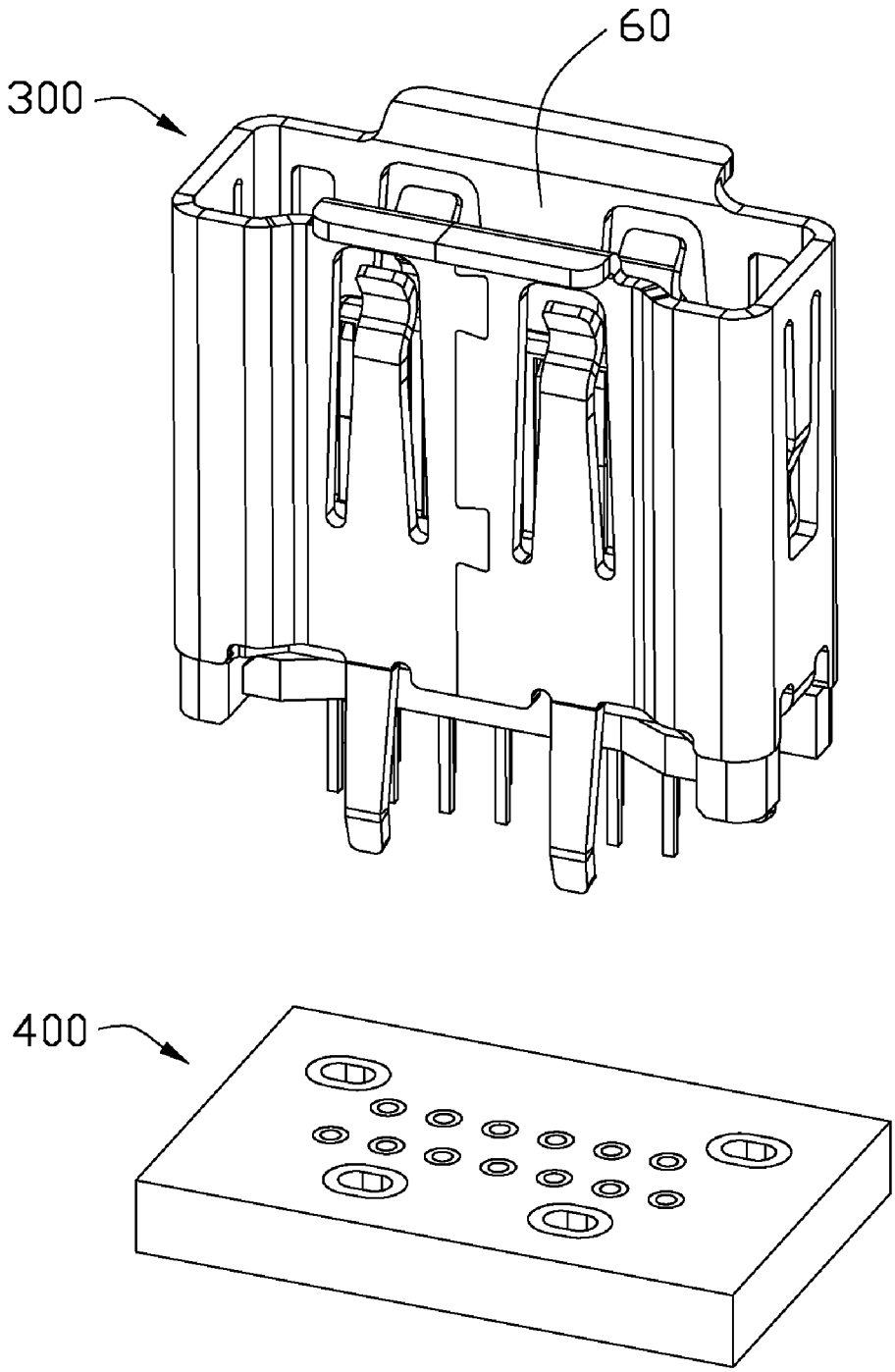
FIG. 5 a perspective view of an electrical connector and a printed circuit board for the electrical connector mounted thereon according to another embodiment of the present invention.
Figure 6:
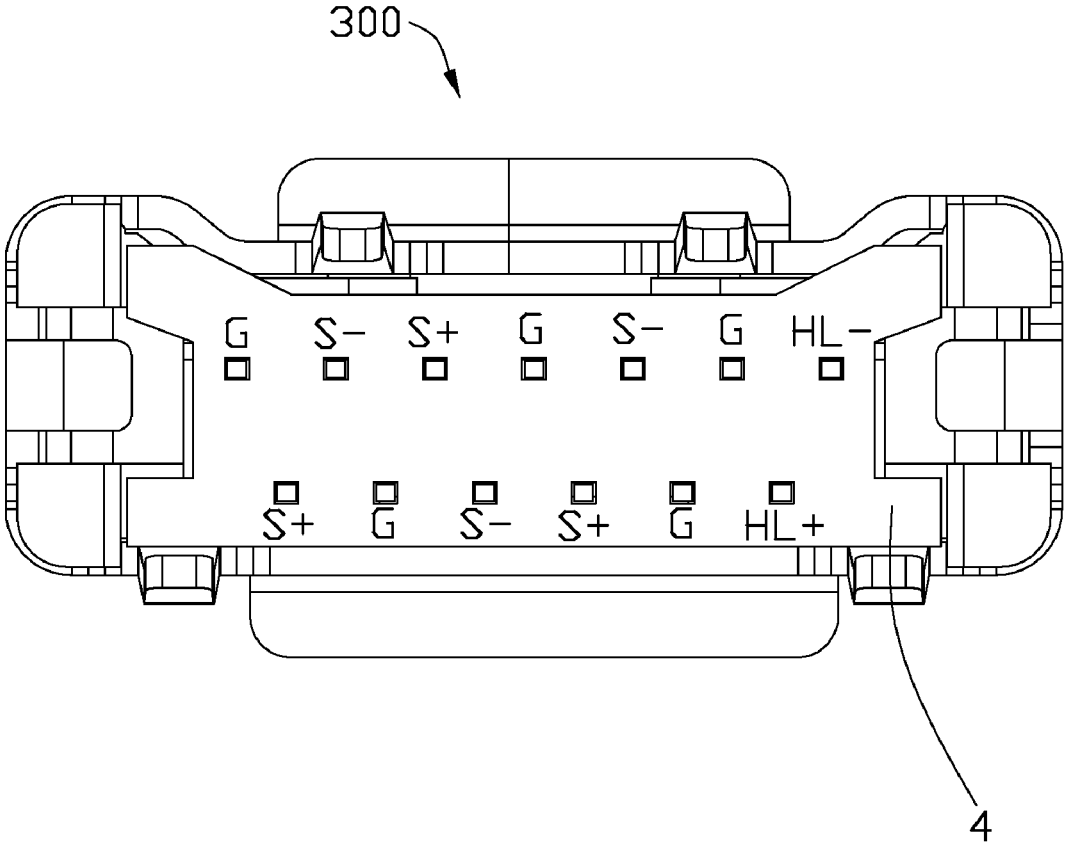
FIG. 6 is a bottom plan view of the electrical connector shown in FIG. 5.
Figure 7:
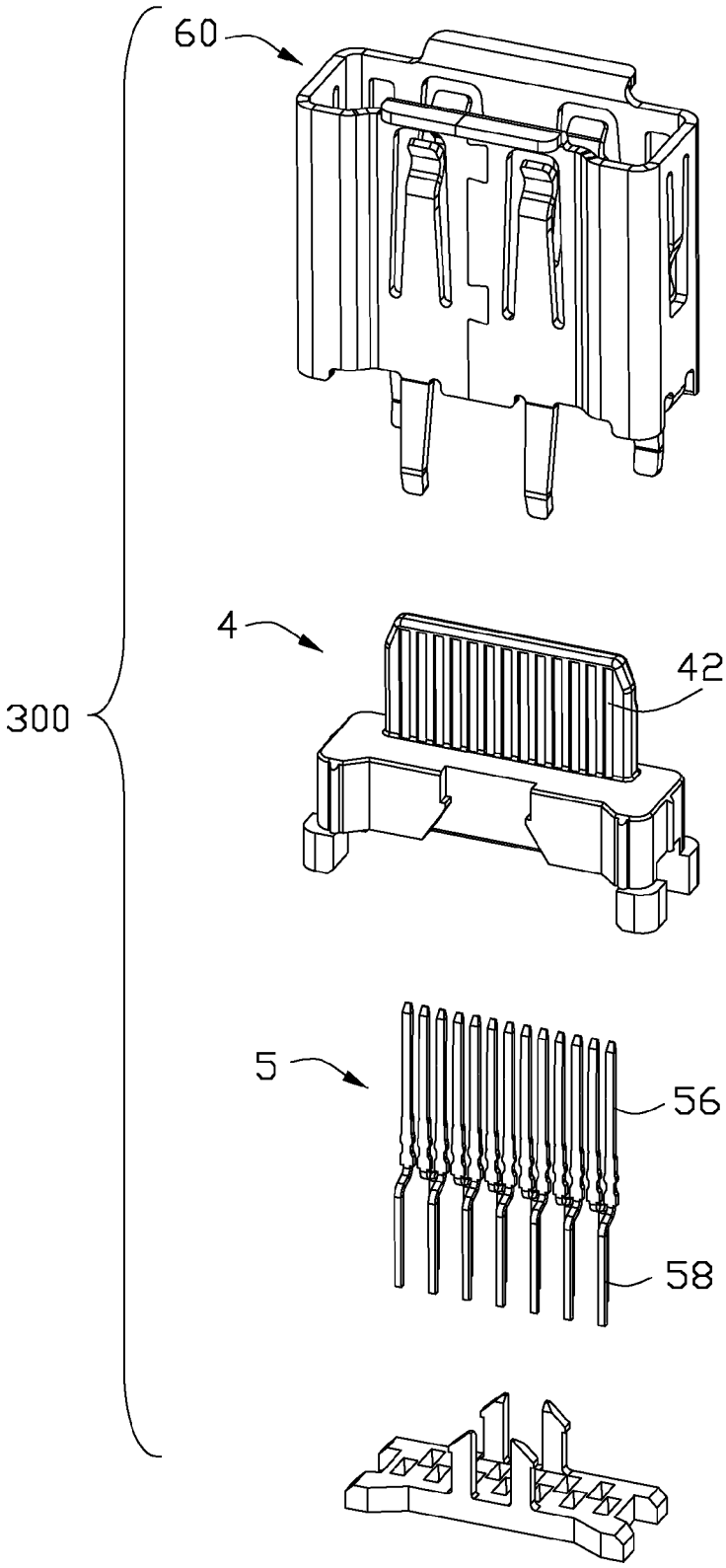
FIG. 7 is an exploded view of the electrical connector shown in FIG. 5.

Referring to FIG. 5-7, the electrical connector 300 according to a second embodiment of the present invention for being mounted onto and orthogonal to the PCB 400 is disclosed. The tongue plate 42 of the insulative housing 4 protruding upwardly into the receiving space 60. The contacting portions 56 of the contacts 5 are arranged in one row and have the same arrangement as the contacting portions 26 of the electrical connector 100 in the first embodiment, and the tail portions 58 of the contacts 5 are arranged in two rows and have the same arrangement as the tail portions 28 of the electrical connector 100 in the first embodiment.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted onto a printed circuit board comprising:

an insulative housing including a base and a tongue plate protruding from the base;

a plurality of contacts having contacting portions retained in the tongue plate and arranged in one row along a transverse direction, and tail portions opposite to the contacting portions and arranged in two rows along a front-to-back direction perpendicular to the transverse direction for being mounted onto the printed circuit board, the contacts consisting of a plurality of grounding contacts and a plurality of pairs of differential contacts under condition that each two adjacent pairs of differential contacts have at least one grounding contact located therebetween, at the tail portions; each pair of differential contacts comprising a first and a second tail portions arranged in the two rows respectively; and a metal shell covering the insulative housing.

2. The electrical connector according to claim 1, wherein the first and second tail portions are staggered with each other in the transverse direction.

3. The electrical connector according to claim 1, wherein the two adjacent pairs of differential contacts have at least one grounding contact located therebetween at both the contacting portions and the tail portions in the transverse direction.

4. The electrical connector according to claim 1, wherein all of the tail portions arranged in one of the two rows are staggered with all of the tail portions arranged in the other row along the transverse direction.

5. The electrical connector according to claim 1, wherein the differential contacts comprise three pairs of first differential contacts for unidirectionally transmitting data and a pair of second differential contacts for bi-directionally transmitting hybrid data, the grounding contacts comprise three grounding contacts alternatively arranged with the three pairs of first differential contacts both at the contacting portions and the tail portions along the transverse direction.

6. The electrical connector according to claim 5, wherein the grounding contacts further comprise two grounding contacts arranged between one pair of first differential contacts and the pair of second differential contacts both at the contacting portions and the tail portions along the transverse direction.

7. The electrical connector according to claim 6, wherein the tail portions of the two grounding contacts are arranged in the two rows respectively and staggered with each other along a transverse direction.

8. The electrical connector according to claim 5, wherein the first tail portions of two pairs of first differential contacts and the pair of second differential contacts are arranged in one row of the two rows, the second tail portions of the two pairs of first differential contacts and the pair of second differential contacts are arranged in the other row, the first tail portion of the remaining pair of first differential contacts is arranged in the other row, and the second tail portion of the remaining pair of first differential contacts is arranged in the one row.

9. An electrical connector for being mounted onto a printed circuit board comprising:

an insulative housing including a base and a tongue plate protruding from the base;

a plurality of contacts having contacting portions retained in the tongue plate and arranged in one row along a transverse direction, and tail portions opposite to the contacting portions and arranged in two rows along a front-to-back direction perpendicular to the transverse direction for being mounted onto the printed circuit board, the contacts comprising a pair of first differential contacts for unidirectionally transmitting data, a pair of second differential contacts for bi-directionally transmitting data and a pair of grounding contacts arranged between the pair of first and the pair of second differential contacts at both the contacting portions and the tail portions.

10. The electrical connector according to claim 9, wherein relevant to the tail portions, each pair of first differential contacts, second differential contacts, and grounding contacts are arranged in the two rows respectively.

11. The electrical connector according to claim 10, wherein all of the tail portions arranged in one of the two rows are staggered with all of the tail portions arranged in the other row along the transverse direction.

12. The electrical connector according to claim 11, wherein the contacts further comprise two pairs of first differential contacts for unidirectionlly transmitting data and three grounding contacts alternatively arranged with the two pairs of first differential contacts both at the contacting portions and the tail portions along the transverse direction.

13. The electrical connector according to claim 12, wherein each pair of first differential contacts include a + data contact and – data contact, the tail portions of each pair of first differential contacts includes a first tail portion corresponding to the + data contact and a second tail portion corresponding to the – data, at least two first tail portions are arranged in the two rows respectively.

14. The electrical connector according to claim 12, wherein both at the contacting portions and the tail portions, the contacts are arranged in the following sequence along the transverse direction: a grounding contact, a pair of first differential contacts, a grounding contact, a pair of first differential contacts, a grounding contact, a pair of first differential contacts, two grounding contacts, and a pair of second differential contacts.

15. An electrical connector comprising:

an insulative housing defining a base and a tongue plate extending from the base;

thirteen contacts disposed in the housing and including first, second, third and fourth differential pairs of signal contacts and first, second, third, fourth and fifth grounding contacts with corresponding contacting sections commonly located on a same face of the mating tongue and corresponding tail sections respectively arranged in first and second rows along a transverse direction; and a sequence of said thirteen contacts on the tongue plate along the transverse direction is the first grounding contact, one of the first differential pair, the other of the first differential pair, the second grounding contact, one of the second differential pair, the other of the second differential pair, the third grounding contact, one of the third differential pair, the other of the third differential pair, the fourth grounding contact, the firth grounding contact, one of the fourth differential pair, and the other of the fourth differential pair; wherein only the tail sections of said fourth differential pair do not directly communicatively neighbor any of remaining differential pairs in said transverse direction while each pair of said remaining differential pairs at least has a tail section of one contact directly communicatively neighbors another pair of said remaining differential pairs in said transverse direction.

16. The electrical connector as claimed in claim 15, wherein the tail sections of said fourth differential pairs are respectively located in the first and second row and segregated from said remaining differential pairs by said fourth and fifth grounding contacts in said transverse direction, respectively.

17. The electrical connector as claimed in claim 15, wherein the tail section of the other of the first differential pair and that of the one of the second differential pair are neighboring with each other in the first row while that of the second grounding contact is located in the second row therebetween in the transverse direction to commonly form an isosceles triangle.

18. The electrical connector as claimed in claim 15, wherein the tail section of the third grounding contact cooperates with that of the fifth grounding contact to commonly neighbor and sandwich that of the other of the third differential pair in the first row in said transverse direction.

19. The electrical connector as claimed in claim 15, wherein the tail section of the other of the third differential pair and that of the other of the fourth differential pair commonly neighbor and sandwich that of the fifth grounding contact in the first row in the transverse direction; the tail section of the one of the third differential pair and that of the one of the fourth differential pair commonly neighbor and sandwich that of the fourth grounding contact in the second row in the transverse direction.

20. The electrical connector as claimed in claim 15, wherein each pair of said four differential pair has the corresponding tail sections in said first ad second rows, respectively.

* * * * *